US006834403B1

(12) United States Patent
Elliott

(10) Patent No.: US 6,834,403 B1
(45) Date of Patent: Dec. 28, 2004

(54) BLANKET ELEVATION APPARATUS

(76) Inventor: Herron W. Elliott, 23182 Gay St., Euclid, OH (US) 44123

( * ) Notice: Subject to any disclaimer, the term of this patent is extended or adjusted under 35 U.S.C. 154(b) by 0 days.

(21) Appl. No.: 10/603,325

(22) Filed: Jun. 26, 2003

(51) Int. Cl.[7] ..... A47C 21/02
(52) U.S. Cl. ..... 5/505.1; 5/504.1; 5/426
(58) Field of Search ..... 5/426, 504.1, 505.1

(56) References Cited

U.S. PATENT DOCUMENTS

| | | | | | |
|---|---|---|---|---|---|
| 2,602,171 | A | * | 7/1952 | Good | 5/505.1 |
| 2,642,589 | A | * | 6/1953 | Cobb | 5/505.1 |
| 2,803,021 | A | | 8/1957 | Westgard | |
| 3,196,468 | A | | 7/1965 | McWilliams | |
| 3,317,932 | A | * | 5/1967 | Gibbons, Sr. | 5/505.1 |
| 3,474,473 | A | * | 10/1969 | Hannaberg | 5/426 |
| 3,808,614 | A | | 5/1974 | Reinhard | |
| 4,214,327 | A | | 7/1980 | Smith | |
| 4,493,121 | A | | 1/1985 | Williams | |
| 4,570,275 | A | * | 2/1986 | Merriman | 5/505.1 |
| 4,841,589 | A | * | 6/1989 | Moore | 5/505.1 |
| 5,175,899 | A | | 1/1993 | Lou | |
| 5,329,658 | A | | 7/1994 | Fontenot et al. | |
| 5,881,406 | A | * | 3/1999 | Cobb | 5/505.1 |
| 6,163,901 | A | | 12/2000 | Sargent | |
| 6,240,581 | B1 | | 6/2001 | Pender | |

* cited by examiner

*Primary Examiner*—Michael Trettel
(74) *Attorney, Agent, or Firm*—John Gugliotta; P. Jeff Martin

(57) ABSTRACT

A blanket elevation apparatus is provided for elevating bedding away from the feet of a bed occupant. The blanket elevation apparatus is functional with a traditional bed to adjustably position the bedding thereof relative to its associated mattress. The blanket elevation apparatus includes a base frame retainer adapted to be slidably positioned between the upper mattress and the lower box spring. A bedding elevator includes leg members which slidably engage a pair of leg tubes of the base frame retainer so as to support bedding in spaced relation to the upper mattress.

10 Claims, 6 Drawing Sheets

BLANKET ELEVATION APPARATUS

RELATED APPLICATIONS

The present invention was first described in Disclosure Document Registration No. 527,362 filed on Mar. 4, 2003 under 35 U.S.C. §122, 37 C.F.R. §1.14, and MPEP §1706. There are no previously filed, nor currently any copending applications, anywhere in the world.

BACKGROUND OF THE INVENTION

1. Field of the Invention

The present invention relates generally to bedding support devices and, more particularly, to a blanket elevation apparatus for elevating bedding away from the feet of a bed occupant.

2. Description of the Related Art

The weight of bedding on a bed occupant's feet and ankles can cause considerable discomfort to one suffering from foot ailments. When such person is in need of rest, they prefer to lay in warmth and in comfort while sleeping in their bed, yet the weight of the blanket resting atop the feet and ankles becomes a hindrance to restful sleep.

Accordingly, there is a need for a vertically adjustable device which supports bedding in an elevated manner away from the feet of a bed occupant in a manner which is quick, easy, and effective. The development of the blanket elevation apparatus fulfills this need.

A search of the prior art did not disclose any patents that read directly on the claims of the instant invention; however, the following references were considered related.

The following patents disclose blanket elevation devices for elevating bedding above and out of contact with the feet of a person lying in bed:

U.S. Pat. No. 2,803,021, issued in the name of Westgard;

U.S. Pat. No. 3,196,468, issued in the name of McWilliams;

U.S. Pat. No. 3,808,614, issued in the name of Reinhard;

U.S. Pat. No. 4,214,327, issued in the name of Smith;

U.S. Pat. No. 4,493,121, issued in the name of Williams;

U.S. Pat. No. 5,175,899, issued in the name of Lou;

U.S. Pat. No. 5,329,658, issued in the name of Fontenot et al.;

U.S. Pat. No. 6,163,901, issued in the name of Sargent; and

U.S. Pat. No. 6,240,581 Bi, issued in the name of Pender.

Consequently, a need has been felt for a device which can support bedding away from the feet of a bed occupant in a manner which is quick, easy, and effective.

SUMMARY OF THE INVENTION

Therefore, it is an object of the present invention to provide a blanket elevation apparatus for elevating bedding away from the feet of a bed occupant.

It is still another object of the present invention to provide a blanket elevation apparatus being functional with a traditional bed.

It is still another object of the present invention to provide a base frame retainer which is positioned between the upper mattress and the lower box spring.

It is another object of the present invention to provide a base frame retainer having a pair of leg tubes for slidably receiving lower leg members of a plurality of multiple-sized bedding elevators.

It is another object of the present invention to provide bedding elevators which support bedding in spaced relation to the upper mattress.

It is another object of the present invention to provide a blanket elevation apparatus fabricated of stainless steel which is encapsulated with a soft, pliable rubber material to prevent harm to the skin of bed occupant.

Briefly described according to one embodiment of the present invention, a blanket elevation apparatus is provided for elevating bedding away from the feet of a bed occupant. The blanket elevation apparatus is functional with a traditional bed to adjustably position the bedding thereof relative to its associated mattress. The blanket elevation apparatus comprises a base frame retainer defined by a U-shaped, upper horizontal component, a generally square-shaped, tubular lower horizontal component, and a U-shaped vertical component integrally disposed therebetween. The tubular lower horizontal component is positioned between the upper mattress and the lower box spring, whereby the U-shaped vertical component abuts an end wall of the upper mattress.

Integrally disposed in a parallel manner atop the upper horizontal component are a pair of leg tubes for slidably receiving lower leg members of a plurality of multiple-sized bedding elevators. The lower leg members are removably held within leg tubes via frictional impingement. Each of the pair of lower leg members has a rearward end which extends vertically therefrom into parallel tubular uprights.

The parallel tubular uprights each have a curved upper end which extends horizontally to form a pair of parallel, cylindrical bedding supports having a cross member integrally disposed therebetween. Thus, the bedding elevator is elevated above an upper surface of the upper mattress and supports the bedding thereatop so as to support the bedding in spaced relation to the upper mattress. The bedding elevators are available in a plurality of various sizes.

The use of the present invention affords a bed occupant with selective vertical adjustment of the bedding so as to prevent discomfort or injury to the bed occupant suffering from ankle and feet ailments.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

A. Detailed Description of the Figures

Figure 1:
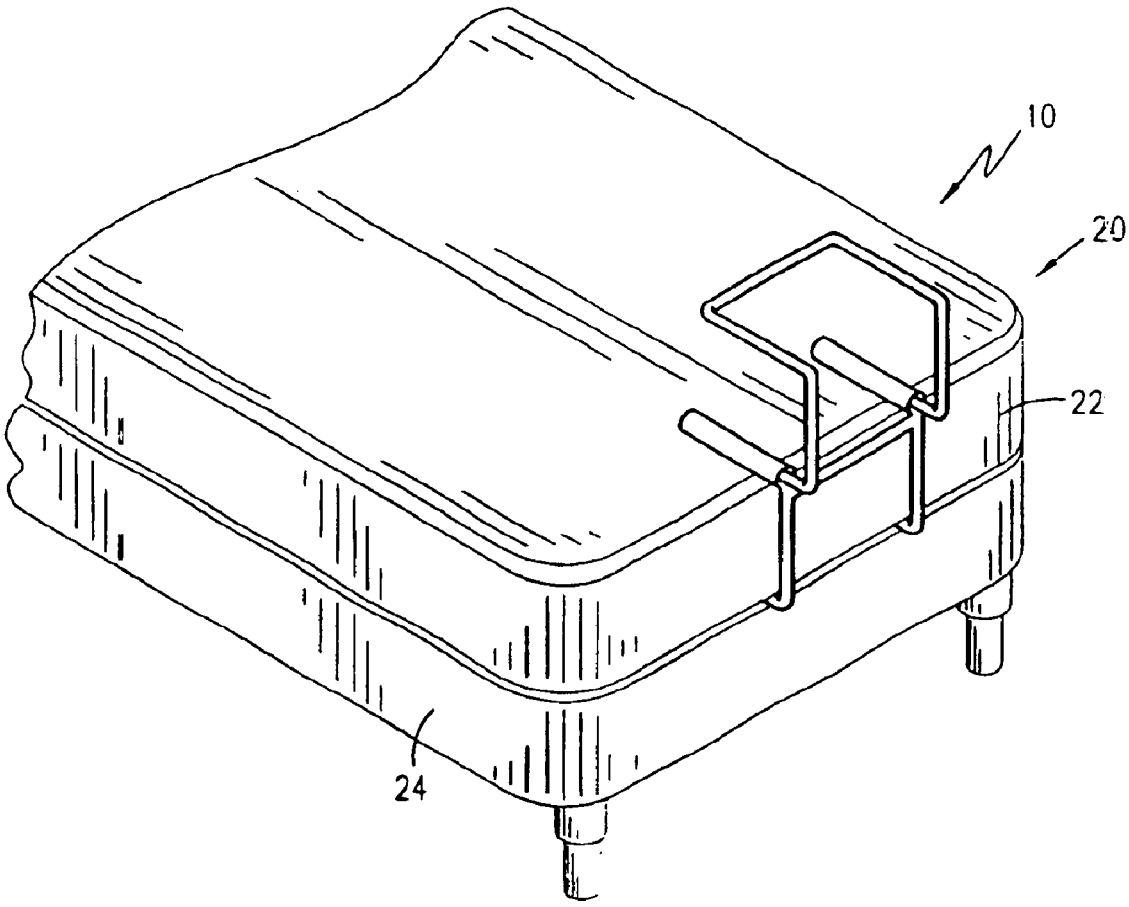
FIG. 1 is a perspective view of a blanket elevation apparatus according to the preferred embodiment of the present invention.
Figure 2:
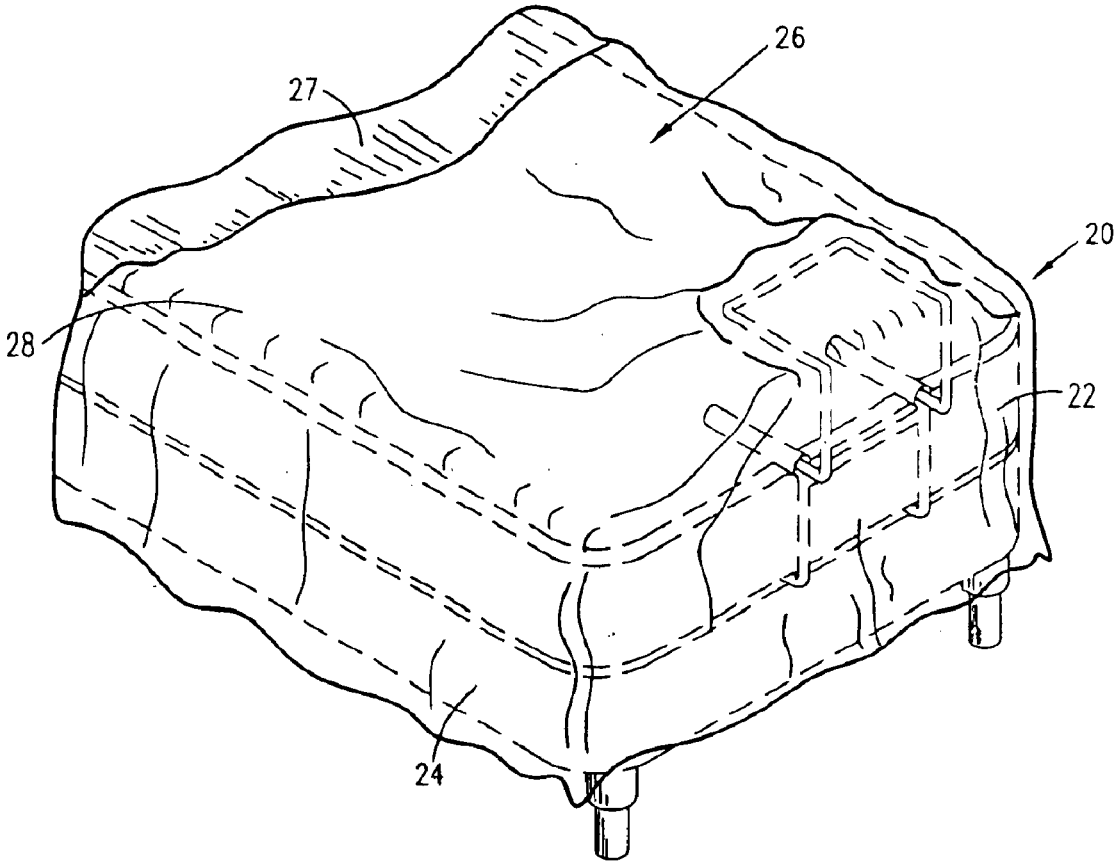
FIG. 2 is a perspective view of the blanket elevation apparatus shown elevating bedding according to the preferred embodiment of the present invention.
Figure 3:
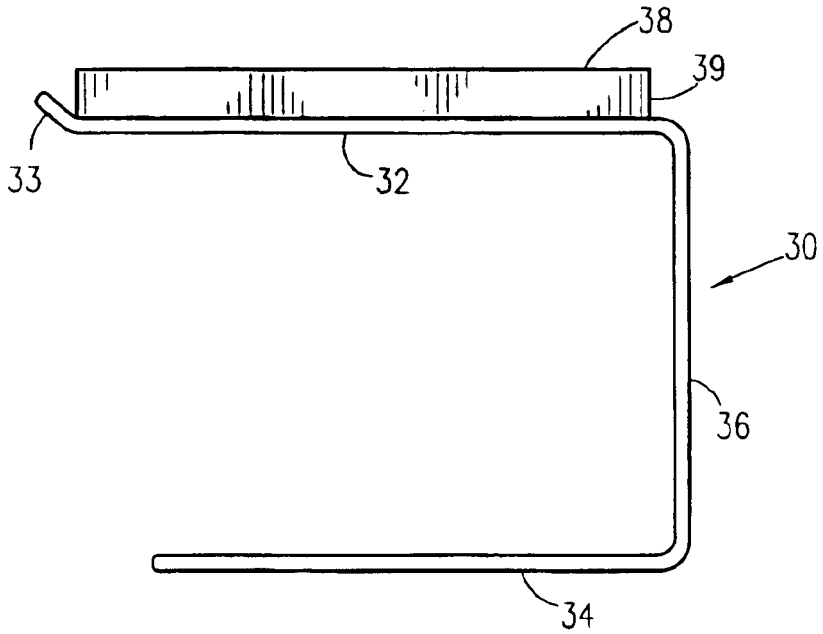
FIG. 3 is a side elevational view of the base frame retainer according to the preferred embodiment of the present invention.
Figure 4:
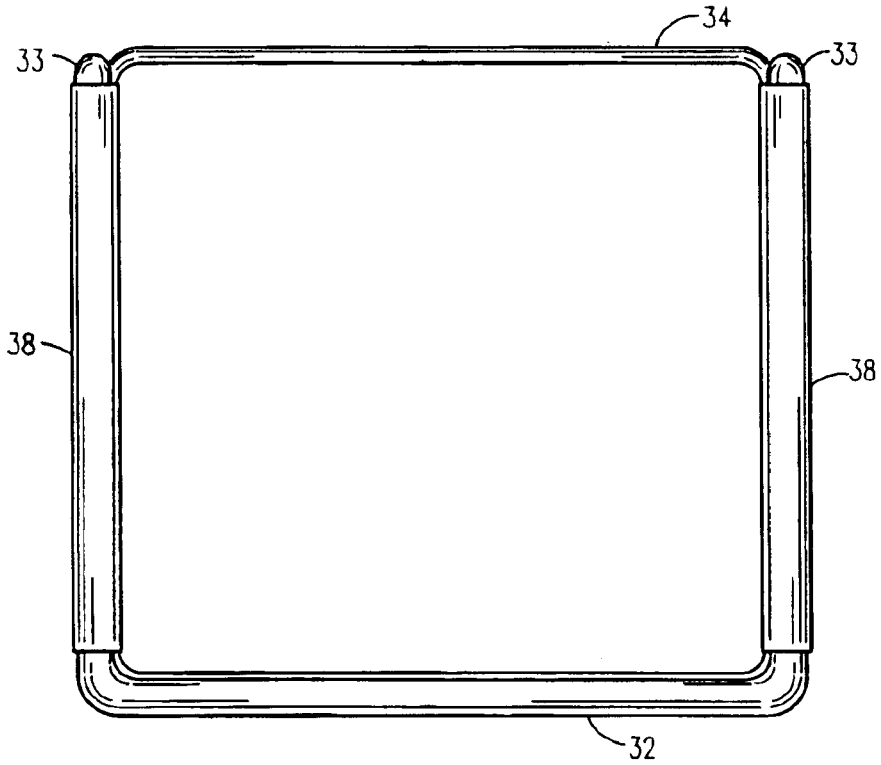
FIG. 4 is a top side view thereof.
Figure 5:
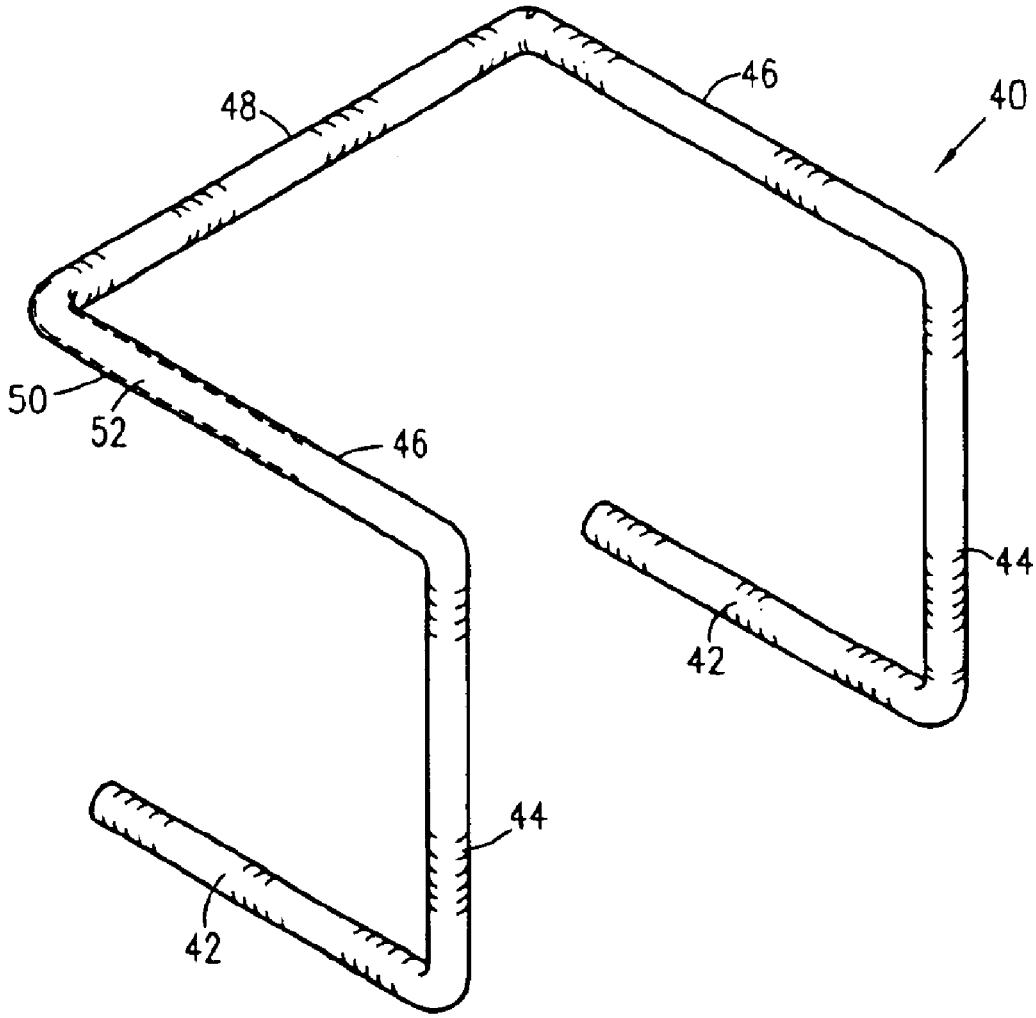
FIG. 5 is a perspective view of the bedding elevator according to the preferred embodiment of the present invention.
Figure 6A:
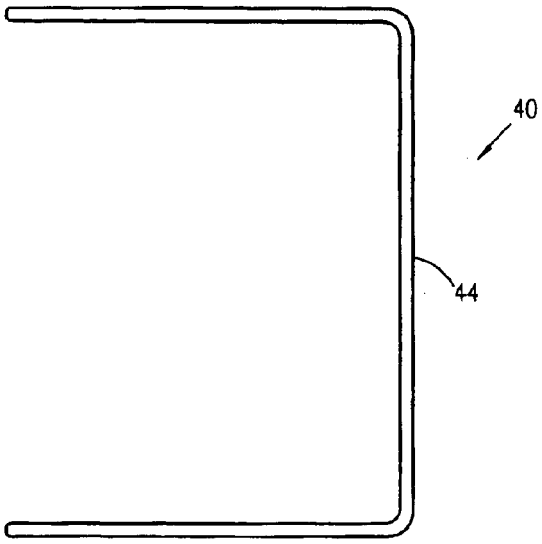
FIGS. 6*a*–6*c* are side elevational views illustrating various linear lengths of tubular uprights of the bedding elevator.
Figure 6B:
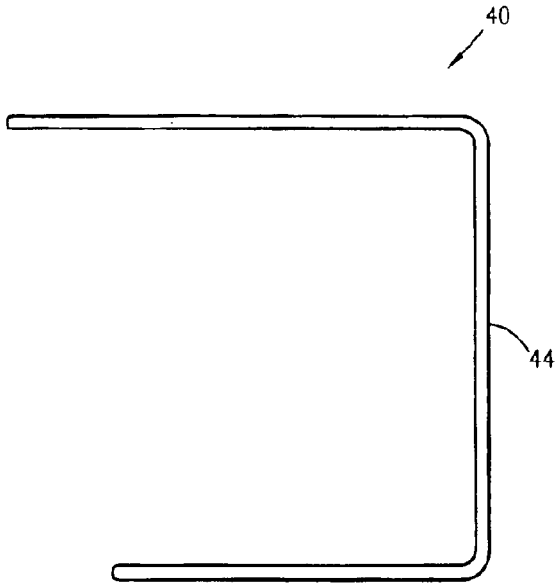
Figure 6C:
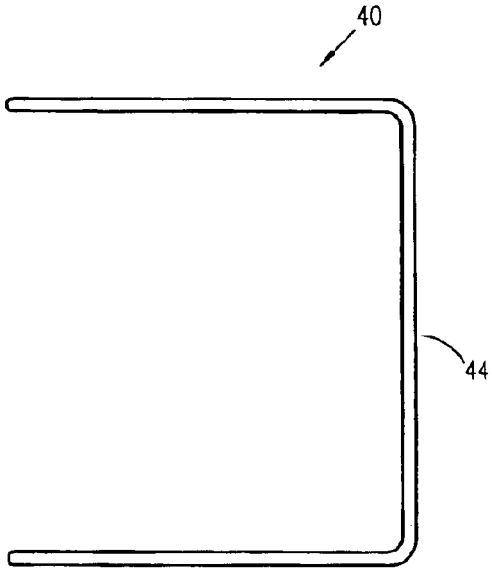
Figure 7:
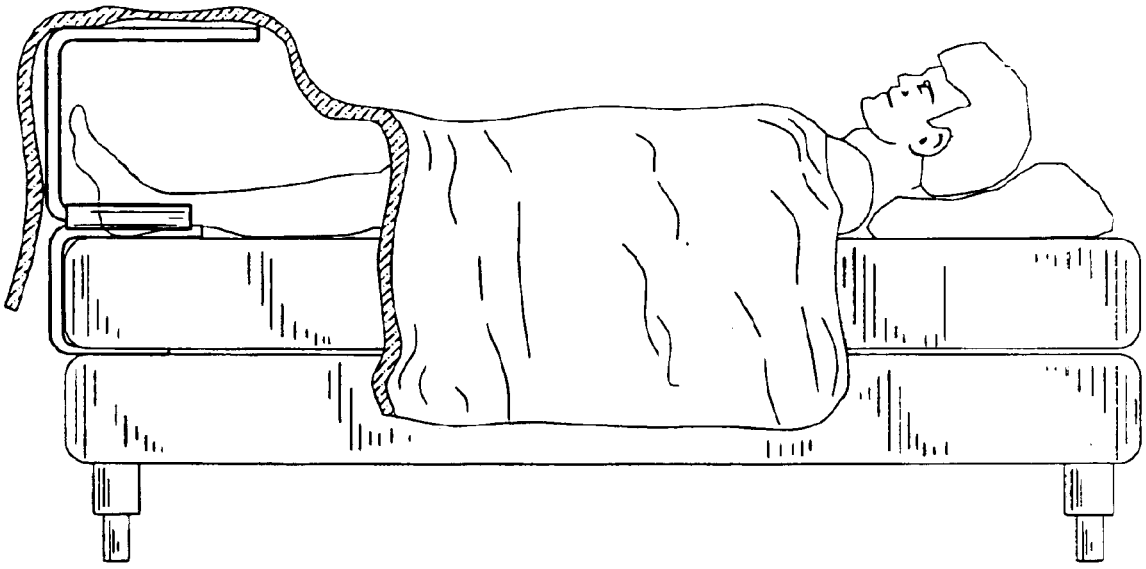
FIG. 7 is a perspective view of the present invention according to the preferred embodiment shown in-use.

Referring now to FIGS. 1–7, a blanket elevation apparatus 10 is shown, according to the present invention, for elevating bedding 26 away from the feet 12 of a bed occupant 15. The blanket elevation apparatus 10 is functional with a traditional bed 20 to adjustably position the bedding 26 thereof relative to its associated mattress 22. For purposes of this disclosure, a traditional bed 20 is defined as having an upper mattress 22 resting atop a lower box spring 24, wherein traditional bed 20 is of a type widely known in the art and the blanket elevation apparatus 10 is adapted for use with any size traditional bed 20. Bedding 26 is defined herein as including a sheet 27 and at least one blanket 28.

The blanket elevation apparatus 10 is comprised of a base frame retainer 30 which defines a U-shaped, upper horizontal component 32, a generally square-shaped, tubular lower horizontal component 34, and a U-shaped vertical component 36 integrally disposed therebetween. The tubular lower horizontal component 34 is positioned between the upper mattress 22 and the lower box spring 24, whereby the U-shaped vertical component 36 abuts an end wall 23 of the upper mattress 22. Forward ends 33 of the upper horizontal component 32 are crispated slightly upward so as to facilitate ease when slidably positioning the base frame retainer 30 between the upper mattress 22 and the lower box spring 24.

Integrally disposed in a parallel manner atop the upper horizontal component 32 are a pair of leg tubes 38 each having a leg entry portal 39 at an end thereof for slidably receiving lower leg members 42 of a plurality of multiple-sized bedding elevators 40. Each bedding elevator 40 includes a pair of cylindrical, parallel-oriented lower leg members 42 having a diameter measuring slightly less than a diameter of the pair of leg tubes 38. The lower leg members 42 are removably held within leg tubes 38 via frictional impingement. Each of the pair of lower leg members 42 has a rearward end which extends vertically therefrom into parallel tubular uprights 44.

The parallel tubular uprights 44 each have a curved upper end which extends horizontally to form a pair of parallel, cylindrical bedding supports 46 having a cross member 48 integrally disposed therebetween. Thus, the bedding elevator 40 is elevated above an upper surface of the upper mattress 22 and supports the bedding 26 thereatop so as to support the bedding 26 in spaced relation to the upper mattress 22. Such space prevents entanglement of the feet 12 and ankles with the bedding 26.

The bedding elevators 40 are available in a plurality of various sizes providing a plurality of tubular uprights 44 defining various linear lengths, thereby affording the bed occupant 15 with selective vertical adjustment of the bedding 26 which prevents discomfort or injury to the bed occupant 15 suffering from ankle and feet ailments.

The blanket elevation apparatus 10 is fabricated of stainless steel 50 which is encapsulated with a soft, pliable rubber material 52 to prevent harm to the skin of bed occupant 15. Alternatively, it is envisioned that the blanket elevation apparatus 10 is fabricated of a rigid plastic material encapsulated with a soft, pliable rubber material 50.

2. Operation of the Preferred Embodiment

To use the present invention, user positions the tubular lower horizontal component 34 of the base frame retainer 30 between the upper mattress 22 and the lower box spring 24, whereby the U-shaped vertical component 36 abuts an end wall 23 of the upper mattress 22. Next, user selects a desired bedding elevator 40 and slidably inserts the pair of cylindrical, parallel-oriented lower leg members 42 within the pair of leg tubes 38, wherein the lower leg members 42 are removably held therein via frictional impingement. The bedding 26 is supported atop the bedding elevator 40 and as such, creates a space between the upper mattress 22 and bedding 26 thereby preventing entanglement of the feet 12 and ankles with the bedding 26.

The use of the present invention affords a bed occupant with selective vertical adjustment of the bedding so as to prevent discomfort or injury to the bed occupant suffering from ankle and feet ailments.

Therefore, the foregoing description is included to illustrate the operation of the preferred embodiment and is riot meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. A blanket elevation apparatus comprising a base frame retainer, said base frame retainer is adapted to be slidably positioned between an upper mattress and a lower box spring of a traditional bed, wherein said base frame retainer defines a U-shaped, upper horizontal component, a generally square-shaped, tubular lower horizontal component, and a U-shaped vertical component, said U-shaped vertical component is integrally disposed between said upper horizontal component and said tubular lower horizontal component; and a bedding elevator, said bedding elevator is adapted to be removably connected to said base frame retainer.

2. The blanket elevation apparatus of claim 1, wherein said tubular lower horizontal component is positioned between the upper mattress and the lower box spring of traditional bed, whereby said vertical component abuts an end wall of the upper mattress.

3. The blanket elevation apparatus of claim 1, wherein said upper horizontal component has forward ends being crispated slightly upward so as to facilitate ease when slidably positioning said base frame retainer between the upper mattress and the lower box spring.

4. The blanket elevation apparatus of claim 1, wherein said bedding elevator includes a pair of cylindrical, parallel-oriented lower leg members, wherein each of said lower leg members has a rearward end which extends vertically therefrom into parallel tubular uprights.

5. The blanket elevation apparatus of claim 4, wherein each of said parallel tubular uprights has a curved upper end which extends horizontally to form a pair of parallel, cylindrical bedding supports having a cross member integrally disposed therebetween.

6. The blanket elevation apparatus of claim 3, wherein said upper horizontal component has a pair of leg tubes integrally disposed in a parallel manner atop said upper horizontal component, and wherein said pair of leg tubes has a leg entry portal at ends thereof for slidably receiving lower leg members of said bedding elevator.

7. The blanket elevation apparatus of claim 6, wherein said lower leg members of said bedding elevator have a diameter measuring slightly less than a diameter of said pair of leg tubes, and wherein said lower leg members are removably held within said pair of leg tubes via frictional impingement, thereby elevating said bedding elevator above an upper surface of the upper mattress, and thus facilitating support of bedding associated with traditional bed atop said bedding elevator so as to support the bedding in spaced relation to the upper mattress in order to prevent entanglement of one's feet and ankles with the bedding.

8. The blanket elevation apparatus of claim 7, wherein said bedding elevator is available in a plurality of various sizes providing a plurality of tubular uprights defining various linear lengths, thereby affording a bed occupant with selective vertical adjustment of the bedding.

9. The blanket elevation apparatus of claim 1, wherein said base frame retainer and said bedding elevator is fabricated of stainless steel which is encapsulated with a soft, pliable rubber material to prevent harm to skin of bed occupant.

10. The blanket elevation apparatus of claim 1, wherein said base frame retainer and said bedding elevator is fabricated of a rigid plastic material encapsulated with a soft, pliable rubber material to prevent harm to skin of bed occupant.

* * * * *